US008042971B2

(12) United States Patent
Medendorp, Jr. et al.

(10) Patent No.: US 8,042,971 B2
(45) Date of Patent: Oct. 25, 2011

(54) LIGHT EMITTING DEVICE (LED) LIGHTING SYSTEMS FOR EMITTING LIGHT IN MULTIPLE DIRECTIONS AND RELATED METHODS

(75) Inventors: Nicholas W. Medendorp, Jr., Raleigh, NC (US); Norbert Hiller, Chapel Hill, NC (US)

(73) Assignee: Cree, Inc., Durham, NC (US)

( * ) Notice: Subject to any disclaimer, the term of this patent is extended or adjusted under 35 U.S.C. 154(b) by 360 days.

(21) Appl. No.: 12/046,549

(22) Filed: Mar. 12, 2008

(65) Prior Publication Data

US 2009/0002986 A1 Jan. 1, 2009

Related U.S. Application Data

(63) Continuation-in-part of application No. 11/928,112, filed on Oct. 30, 2007, now abandoned.

(60) Provisional application No. 60/937,383, filed on Jun. 27, 2007.

(51) Int. Cl.
*F21V 21/00* (2006.01)

(52) U.S. Cl. ..... 362/249.06; 362/311.02; 362/310; 362/307; 362/243

(58) Field of Classification Search ..... 362/231, 362/255–256, 249.02–249.06, 241, 243, 362/245–248, 84, 310, 296.07–296.08, 311.02, 362/329, 800, 307, 308, 311.01, 311.03, 362/341

See application file for complete search history.

(56) References Cited

U.S. PATENT DOCUMENTS

| | | | |
|---|---|---|---|
| 3,805,937 | A | 4/1974 | Hatanaka et al. |
| 3,927,290 | A | 12/1975 | Denley |
| 4,325,146 | A | 4/1982 | Lennington |
| 4,408,157 | A | 10/1983 | Beaubien |
| 4,420,398 | A | 12/1983 | Castino |
| 4,918,497 | A | 4/1990 | Edmond |
| 4,966,862 | A | 10/1990 | Edmond |
| 5,027,168 | A | 6/1991 | Edmond |
| 5,087,883 | A | 2/1992 | Hoffman |
| 5,210,051 | A | 5/1993 | Carter, Jr. |
| 5,264,997 | A | 11/1993 | Hutchisson et al. |

(Continued)

FOREIGN PATENT DOCUMENTS

| | | |
|---|---|---|
| EP | 1 081 771 | 3/2001 |

(Continued)

OTHER PUBLICATIONS

Medendorp, Jr., Nicholas W., "LED Lighting Systems Including Luminescent Layers on Remote Reflectors," U.S. Appl. No. 11/708,818.

(Continued)

*Primary Examiner* — Thomas M Sember
(74) *Attorney, Agent, or Firm* — Myers Bigel Sibley & Sajovec

(57) ABSTRACT

Lighting systems for emitting light in multiple directions including one or more light emitting devices (LEDs) and a housing configured to receive the one or more LEDs are provided. The one or more LEDs are configured to generate light in a first direction to illuminate a first area proximate to the lighting system. The housing is configured to reflect a portion of the generated light so as to allow a remaining portion of the generated light to pass through the housing in a second direction, different from the first direction, and illuminate a second area proximate to the lighting system. Related methods are also provided herein.

13 Claims, 6 Drawing Sheets

U.S. PATENT DOCUMENTS

| | | | | |
|---|---|---|---|---|
| 5,338,944 | A | 8/1994 | Edmond et al. | |
| 5,393,993 | A | 2/1995 | Edmond et al. | |
| 5,407,799 | A | 4/1995 | Studier | |
| 5,410,519 | A | 4/1995 | Hall et al. | |
| 5,416,342 | A | 5/1995 | Edmond et al. | |
| 5,523,589 | A | 6/1996 | Edmond et al. | |
| 5,563,849 | A | 10/1996 | Hall et al. | |
| 5,604,135 | A | 2/1997 | Edmond et al. | |
| 5,631,190 | A | 5/1997 | Negley | |
| 5,739,554 | A | 4/1998 | Edmond et al. | |
| 5,749,646 | A | 5/1998 | Brittell | |
| 5,912,477 | A | 6/1999 | Negley | |
| 6,095,666 | A | 8/2000 | Salam | |
| 6,120,600 | A | 9/2000 | Edmond et al. | |
| 6,187,606 | B1 | 2/2001 | Edmond et al. | |
| 6,201,262 | B1 | 3/2001 | Edmond et al. | |
| 6,292,901 | B1 | 9/2001 | Lys et al. | |
| 6,335,538 | B1 | 1/2002 | Prutchi et al. | |
| 6,348,766 | B1 | 2/2002 | Ohishi et al. | |
| 6,357,889 | B1 * | 3/2002 | Duggal et al. | 362/84 |
| 6,394,621 | B1 | 5/2002 | Hanewinkel, III | |
| 6,499,860 | B2 | 12/2002 | Begemann | |
| 6,592,810 | B2 | 7/2003 | Nishida et al. | |
| 6,624,350 | B2 | 9/2003 | Nixon et al. | |
| 6,791,119 | B2 | 9/2004 | Slater, Jr. et al. | |
| 6,791,257 | B1 | 9/2004 | Sato et al. | |
| 6,851,834 | B2 | 2/2005 | Leysath | |
| 6,853,010 | B2 | 2/2005 | Slater, Jr. et al. | |
| 6,880,954 | B2 | 4/2005 | Ollett et al. | |
| 6,958,497 | B2 | 10/2005 | Emerson et al. | |
| 6,964,507 | B2 | 11/2005 | Mohacsi | |
| 7,093,958 | B2 | 8/2006 | Coushaine | |
| 7,210,817 | B2 | 5/2007 | Lee et al. | |
| 7,232,212 | B2 | 6/2007 | Iwase | |
| 7,554,129 | B2 | 6/2009 | Roth et al. | |
| 2002/0087532 | A1 | 7/2002 | Barritz et al. | |
| 2003/0016536 | A1 | 1/2003 | Lin | |
| 2005/0243552 | A1 * | 11/2005 | Maxik | 362/249 |
| 2006/0268565 | A1 * | 11/2006 | Chang | 362/540 |
| 2007/0223219 | A1 | 9/2007 | Medendorp et al. | |
| 2007/0247414 | A1 | 10/2007 | Roberts | |
| 2007/0247847 | A1 | 10/2007 | Villard | |
| 2007/0262337 | A1 | 11/2007 | Villard | |
| 2008/0170396 | A1 | 7/2008 | Yuan et al. | |
| 2008/0192493 | A1 | 8/2008 | Villard | |
| 2008/0231201 | A1 | 9/2008 | Higley et al. | |
| 2009/0002986 | A1 | 1/2009 | Medendorp et al. | |

FOREIGN PATENT DOCUMENTS

| | | |
|---|---|---|
| EP | 1 111 966 | 6/2001 |
| WO | WO 98/43014 | 10/1998 |
| WO | WO 00/34709 | 6/2000 |

OTHER PUBLICATIONS

U.S. Appl. No. 12/146,018, filed Jun. 25, 2008, Roberts.

Narendran et al., "Solid-state lighting: failure analysis of white LEDs", Journal of Crystal Growth, vol. 268, Issues 3-4, Aug. 1, 2004, Abstract.

European Search Report for Application No. 06845870.2 (Mail Date: Nov. 6, 2008).

International Search Report for Application No. PCT/US06/48521 (Mail Date: Feb. 7, 2008).

* cited by examiner

LIGHT EMITTING DEVICE (LED) LIGHTING SYSTEMS FOR EMITTING LIGHT IN MULTIPLE DIRECTIONS AND RELATED METHODS

CROSS-REFERENCE TO RELATED APPLICATION

This application claims priority under 35 U.S.C. §120 as a continuation-in-part application of U.S. patent application Ser. No. 11/928,112, filed on Oct. 30, 2007, now abandoned, and U.S. Provisional Application No. 60/937,383, filed Jun. 27, 2007, the disclosures of which are hereby incorporated herein by reference as if set forth in their entirety.

FIELD OF THE INVENTION

The present invention relates to lighting, and more particularly, to light emitting device (LED) lighting systems and related methods.

BACKGROUND OF THE INVENTION

Typically, high intensity discharge (HID) bulbs are used to illuminate buildings having high ceilings, such as warehouses, cargo bays and the like. These HID bulbs are well suited for these applications as they typically emit light in all directions through a housing, for example, a glass or plastic housing. Thus, both the area above the HID bulb, for example, the ceiling, and below the HID bulb, for example, the floor, may be illuminated. Unfortunately, HID bulbs are typically only about 75 percent efficient. Thus, more efficient HID bulbs and/or lighting systems may be desirable.

SUMMARY OF EMBODIMENTS OF THE PRESENT INVENTION

Some embodiments of the present invention provide a lighting system for emitting light in multiple directions including one or more light emitting devices (LEDs) and a housing configured to receive the one or more LEDs. The one or more LEDs are configured to generate light in a first direction to illuminate a first area proximate to the lighting system. The housing is configured to reflect a portion of the generated light so as to allow a remaining portion of the generated light to pass through the housing in a second direction, different from the first direction, and illuminate a second area proximate to the lighting system.

In further embodiments of the present invention, from about 75 to about 90 percent of a total amount of light generated by the one or more LEDs may illuminate the first area. Similarly, from about 10 to about 25 percent of the total amount of light generated by the one or more LEDs may illuminate the second area.

In still further embodiments of the present invention, the viewing angle of the one or more LEDs is from about 100 to about 120 degrees.

In some embodiments of the present invention, a lens may be provided between the one or more LEDs and the first area proximate to the lighting system. The lens may be configured to diffuse the light generated to illuminate the first area.

In further embodiments of the present invention, the housing may define a cavity and the one or more LEDs may be positioned to emit light into the cavity towards the housing. The housing may be further configured to reflect at least a portion of the light emitted into the cavity to illuminate the first area proximate to the lighting system. In certain embodiments of the present invention, the housing may include a semi-reflective housing including, for example, silver, chrome, metal alloys and/or any semi-reflective material.

In still further embodiments of the present invention, the one or more LEDs may include one or more blue LEDs. In these embodiments of the present invention, the system may further include a transparent lens between the one or more blue LEDs and the first area proximate the lighting system. A phosphor coating may be provided on the transparent lens between the transparent lens and the one or more blue LEDs. The phosphor coating may be configured to allow the lighting system including the one or more blue LEDs to provide white light in the first direction.

In some embodiments of the present invention, the first direction may be below the housing, for example, a floor of the building, and the second direction may be above the housing, for example, a ceiling of the building.

Further embodiments of the present invention provide lighting systems for emitting light in multiple directions including two or more LEDs and a housing. The housing is configured to receive a first of the two or more LEDs on a first surface of the housing and a second of the two or more LEDs on a second surface of the housing. The first of the two or more LEDs is configured to generate light in a first direction to illuminate a first area proximate to the lighting system. The second of the two or more LEDs is configured to generate light in a second direction, different from the first direction, to illuminate a second area proximate to the lighting system.

In still further embodiments of the present invention, the housing may be substantially reflective. The housing may define a cavity. The first surface of the housing may be an internal surface of the cavity and the second surface of the housing may be an external surface of the cavity. The first area may be below the housing and the second area may be above the housing.

Some embodiments of the present invention provide lighting systems including one or more LEDs configured to generate light in a first direction and a reflective housing. The reflective housing is configured to direct the generated light in a primary direction to illuminate a selected area proximate to the lighting system.

In further embodiments of the present invention, the housing may be substantially reflective and define a cavity. The one or more LEDs may be positioned on a first surface of the housing inside the cavity and configured to illuminate the selected area. The system may further include one or more LEDs on a second surface of the housing outside the cavity and configured to generate light in a second direction, different from the first direction, to illuminate a second area, different from the first area, proximate the lighting system. The selected area may be below the housing and the second area may be above the housing.

Although embodiments of the present invention are primarily discussed above with respect to lighting systems, related methods are also provided herein.

DETAILED DESCRIPTION OF EMBODIMENTS OF THE INVENTION

Figure 1:
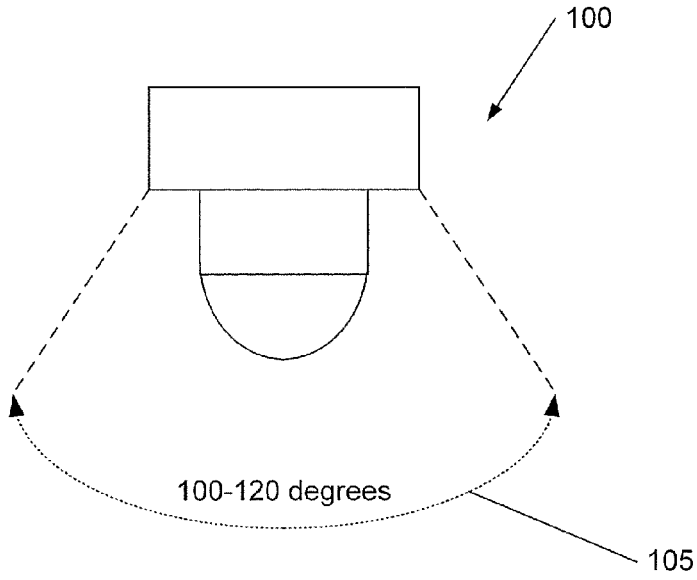
FIG. 1 is block diagram of a light emitting device (LED) illustrating a viewing angle thereof according to some embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. Dimensions of layers, elements, and structures may be exaggerated for clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures. For example, as discussed herein, lighting systems are discussed that illuminate areas above and below the housing of the lighting systems. However, it will be understood that if the housing is turned over, what was previously above the housing would be below the housing and what was previously below the housing would be above the housing.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Various embodiments of the present invention including semiconductor light emitting devices (LEDs) will be described herein. As used herein, the term semiconductor LED may include a light emitting diode, laser diode and/or other semiconductor device that includes one or more semiconductor layers, which may include, for example, silicon, silicon carbide, gallium nitride and/or other semiconductor materials. An LED may or may not include a substrate such as a sapphire, silicon, silicon carbide and/or another microelectronic substrate. An LED may include one or more contact layers, which may include metal and/or other conductive layers. In some embodiments, ultraviolet, blue and/or green light emitting diodes may be provided. Red and/or amber LEDs may also be provided. The design and fabrication of semiconductor LEDs are well known to those having skill in the art and, therefore, in the interest of brevity, will not be discussed in detail herein.

For example, semiconductor LEDs discussed herein may be gallium nitride-based LEDs or lasers fabricated on a silicon carbide substrate, such as those devices manufactured and sold by Cree, Inc. of Durham, N.C. The present invention may be suitable for use with LEDs and/or lasers as described in U.S. Pat. Nos. 6,958,497; 6,791,119; 6,201,262; 6,187,606; 6,120,600; 5,912,477; 5,739,554; 5,631,190; 5,604,135; 5,523,589; 5,416,342; 5,393,993; 5,338,944; 5,210,051; 5,027,168; 4,966,862 and/or 4,918,497, the disclosures of which are incorporated herein by reference as if set forth fully herein.

Furthermore, phosphor coated LEDs, such as those described in U.S. Pat. No. 6,853,010, entitled Phosphor-Coated Light Emitting Diodes Including Tapered Sidewalls and Fabrication Methods Therefor, the disclosure of which is incorporated by reference herein as if set forth fully, may also be suitable for use in embodiments of the present invention. The LEDs and/or lasers may be configured to operate such that light emission occurs through the substrate. In such embodiments, the substrate may be patterned so as to enhance light output of the devices as is described, for example, in the above-cited U.S. Pat. No. 6,791,119.

Notwithstanding known uses of LEDs to provide lighting, there continues to exist a need in the art for lighting systems providing improved efficiency, brightness, illumination pattern, and/or light color. Accordingly, as discussed herein, LEDs may be used to replace HID bulbs that are currently used to illuminate high ceilings in structures such as warehouses, cargo bays and the like. As discussed above, HID bulbs are well suited for these applications as they typically emit light in all directions through a housing, for example, a glass or plastic housing. Thus, both the area above the HID bulb, for example, the ceiling, and below the HID bulb, for example, the floor, may be illuminated. LEDs, on the other hand, are typically directional. As illustrated by the LED 100 in FIG. 1, a typical viewing angle 105 of an LED may be from about 100 to about 120 degrees. Thus, according to some embodiments of the present invention, lighting systems including LEDs are provided that emit light in multiple directions to, for example, illuminate the floor as well as the ceiling. Illuminating the ceiling as well as the floor may allow the large room(s) to have a less cave-like appearance as will be discussed in detail below with respect to FIGS. 2A through 9.

Figure 2A:
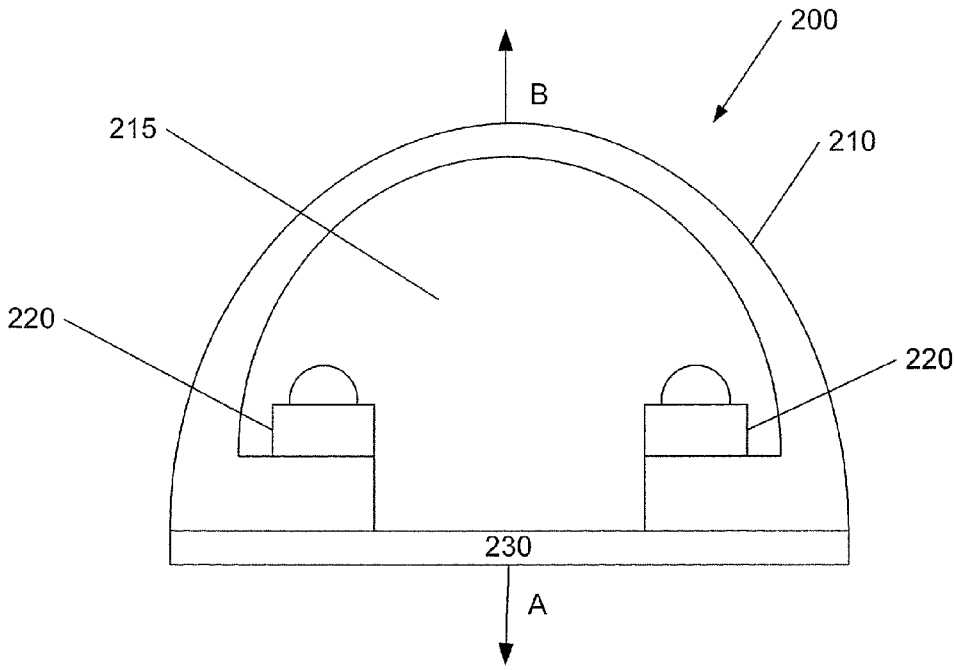
FIG. 2A is a cross section of a lighting system according to some embodiments of the present invention.
Figure 2B:
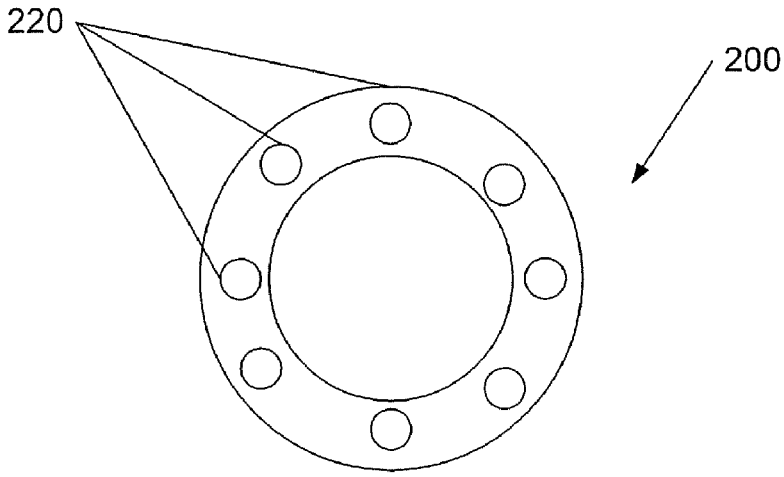
FIG. 2B is a top view of the lighting system of FIG. 2A according to some embodiments of the present invention.

Referring now to FIGS. 2A and 2B, lighting systems including LEDs for emitting light in multiple directions according to some embodiments of the present invention will be discussed. In particular, FIG. 2A is a cross section of a lighting system according to some embodiments of the present invention. FIG. 2B is a top view of the lighting system of FIG. 2A according to some embodiments of the present invention. As illustrated in FIG. 2A, the lighting system 200 may include one or more LEDs 220 and a housing 210. In some embodiments of the present invention, the housing 210 may be almost entirely reflective. However, in some embodiments the housing may only be partially or semi-reflective as will be discussed further herein.

As illustrated in FIG. 2A, the housing 210 may define a cavity 215 configured to direct light emitted from the one or more LEDs 220 in a primary direction, for example, towards the floor or in the A direction of FIG. 2A. Thus, the light emitted in the primary direction (A) may illuminate a first area around or proximate to the lighting system 200. Embodiments of the present invention having the semi-reflective housing may allow a portion of the light generated by the one or more LEDs 220 to pass through the housing 210 in a second direction (B direction of Figure A) to illuminate a second area around or proximate to the lighting system 200. In some embodiments of the present invention, the first area is the floor or area below the lighting system 200 or housing 210 and the second area is the ceiling or area above the lighting system 200 or housing 210.

In some embodiments of the present invention, from about 75 to about 90 percent of a total amount of light generated by the one or more LEDs 220 illuminates the first area (directed in the first direction A) and from about 10 to about 25 percent of the total amount of light generated by the one or more LEDs 220 illuminates the second area (directed in the second direction B).

It will be understood that these percentages are provided for exemplary purposes only and, therefore, embodiments of the present invention should not be limited thereby. For example, the amount of light generated by the one or more LEDs 220, reflected by the housing 210 and/or allowed to pass through the housing 210 may be scalable depending on, for example, the selected material of the reflective housing 210, such as silver, chrome, metal alloys and/or any semi-reflective material. Similarly, the position or angle of the one or more LEDs 220 may be adjusted to change and/or optimize the light output of the lighting system 200 according to some embodiments of the present invention as will be discussed further below.

Furthermore, the LEDs may be any color desired for the application. However, for white light applications, phosphors may be packaged with each LED for wavelength conversion. For example, for white light, the LEDs may be blue chips that are packaged with and/or coated with a phosphor. In some embodiments of the present invention, the phosphor may be located remotely from the LED source as will be discussed further below with respect to FIG. 6.

As further illustrated in FIG. 2A, an optional lens 230 may be provided between the one or more LEDs and the primary direction A. The lens 230 may be configured to diffuse the light generated to illuminate the first area (A). The optional lens 230 may also protect the one or more LEDs 220 in some embodiments of the present invention.

As illustrated in FIG. 2B, the one or more LEDs 220 may be arranged in a pattern inside the housing 210. Although the lighting system 200 illustrated in FIG. 2B has a circular housing 210 having the one or more LEDs 220 arranged in a circular pattern therein, embodiments of the present invention are not limited to this configuration. For example, the housing 210 may be rectangular or elliptical without departing from the scope of the present invention. Alternative mounting options for the one or more LEDs 220 will be discussed further below with respect FIGS. 3 and 4.

It will be understood that although eight LEDs 220 are provided in the lighting system 200 of FIG. 2B, embodiments of the present invention are not limited to this number. The number of LEDs 220 may be increased and/or decreased depending on a desired light output of the lighting system 200 without departing from the scope of the present invention.

Figure 3:
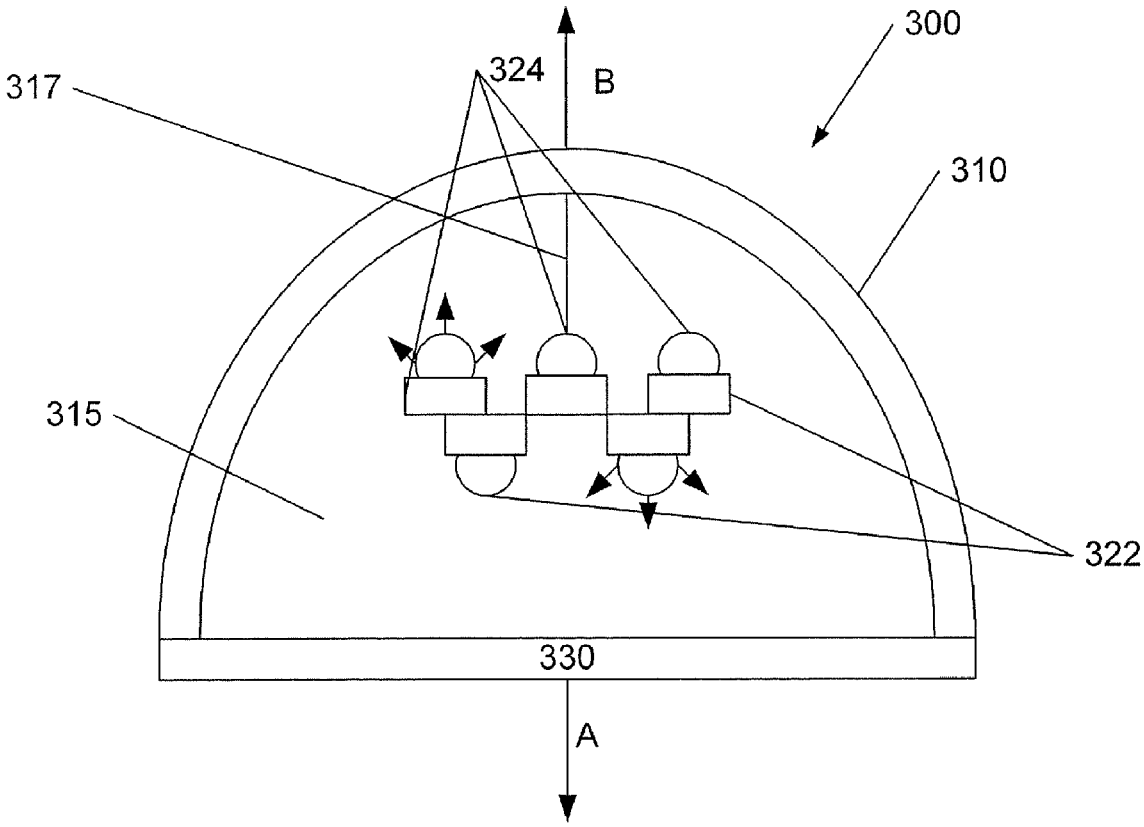
FIG. 3 is a cross section of a lighting system according to some embodiments of the present invention.
Figure 4:
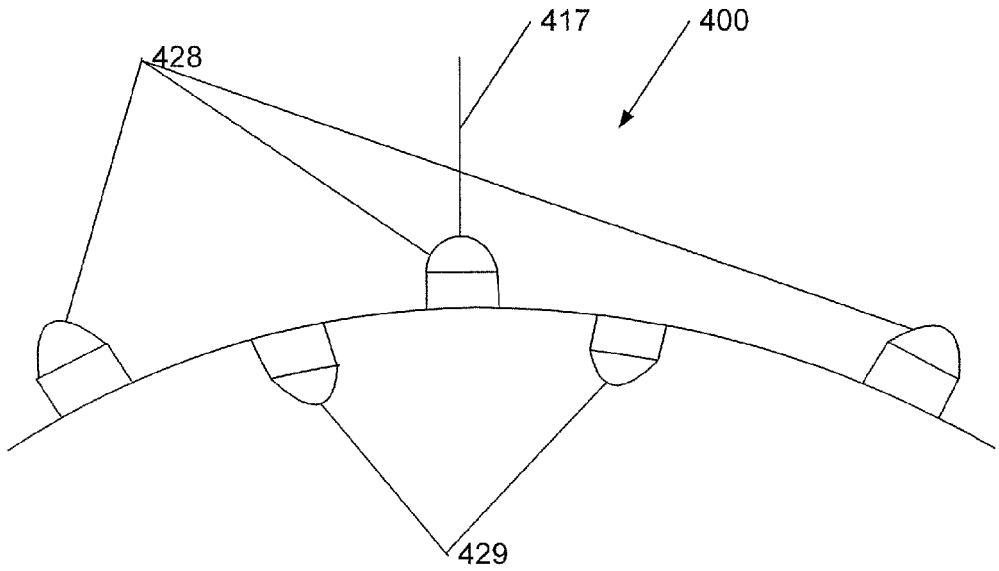
FIG. 4 is a diagram illustrating positioning of LEDs in a housing of a lighting system according to some embodiments of the present invention.

Referring now to FIGS. 3 and 4, alternative arrangements of the one or more LEDs in the housing of the lighting system will be discussed. It will be understood that like reference numerals refer to like elements throughout this specification and, therefore, details with respect to the individual elements will not be repeated herein. As illustrated in FIG. 3, the lighting system 300 includes a housing 310 that defines a cavity 315. As discussed above, the housing 310 may be reflective or semi-reflective. The housing 310 includes an LED mount 317. The mount 317 allows the LEDs to be mounted to emit light in different directions. As illustrated, the LEDs 322 provided on the underside of the mount 317 emit light in the primary direction A and the LEDs 324 provided on an upper portion of the mount 317 emit light in the secondary direction B. Positioning the LEDs 322 and 324 on a mount so that they emit light in multiple directions inside the reflective housing 310 may reduce the occurrence of dark spots in the primary and/or secondary directions A and/or B.

As further illustrated in FIG. 3, the lighting system 300 may include an optional lens 320 to diffuse the light generated by the LEDs 322 and 324 in the primary direction A.

As further illustrated in FIG. 4, the shape of the mount 417 may be modified to further regulate the desired output of the lighting system 400. As illustrated in FIG. 4, the mount 417 is curved to further direct the light generated by the LEDs 428 and 429 inside the reflective housing of the lighting system 400.

Although only two alternative mounting options are provided in FIGS. 3 and 4, it will be understood that embodiments of the present invention are not limited to the options discussed herein. Any mounting scenario may be used without departing from the scope of the present invention. For example, an alternative mounting is provided in the lighting system 900 illustrated in FIG. 9, which will be discussed further below.

Figure 5:
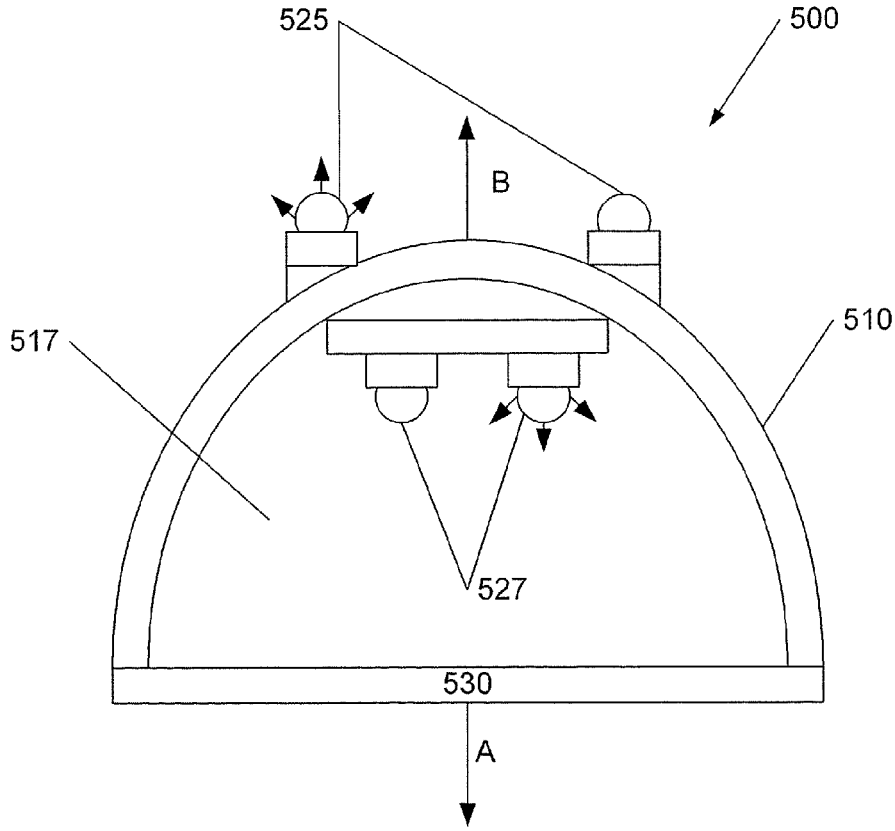
FIG. 5 is a cross section of a lighting system according to some embodiments of the present invention.

Referring now to FIG. 5, a cross section of lighting systems according to some embodiments of the present invention having an almost entirely reflective housing will be discussed. As illustrated in FIG. 5, the lighting system 500 includes a housing 510 that defines a cavity 517. In embodiments of the present invention illustrated in FIG. 5, the housing is almost entirely or substantially reflective. Thus, one or more LEDs 527 are provided on the inside of the housing 510 in the cavity 517 and one or more LEDs 525 are provided on the outside of the housing 510. The one or more LEDs 527 provided on the inside of the housing 510 the first of the two LEDs are configured to generate light which is reflected in a first direction (A) only to illuminate a first area proximate to the lighting system 500. The one or more LEDs 525 on the outside of the housing 510 are configured to generate light in a second direction (B), which is different from the first direction, to illuminate a second area proximate to the lighting system 500.

It will be understood that the location of the LEDs 525 and 527 inside and outside the housing 510 may be adjusted or angled to adjust the light output by the lighting system 500. For example, the LEDs 527 inside the housing 510 may be mounted in a ring and angled towards the reflective housing 510 similar to the configuration discussed above with respect to FIGS. 2A and 2B.

It will be understood that the light generated and reflected in the first/primary direction A may illuminate the floor proximate the lighting system 500 and the light generated in the secondary direction B may be provided for backlight purposes to illuminate the ceiling or area above the lighting system 500.

As further illustrated in FIG. 5, the lighting system 500 may include an optional lens 520 to diffuse the light generated by the LEDs 527 inside the housing.

Figure 6:
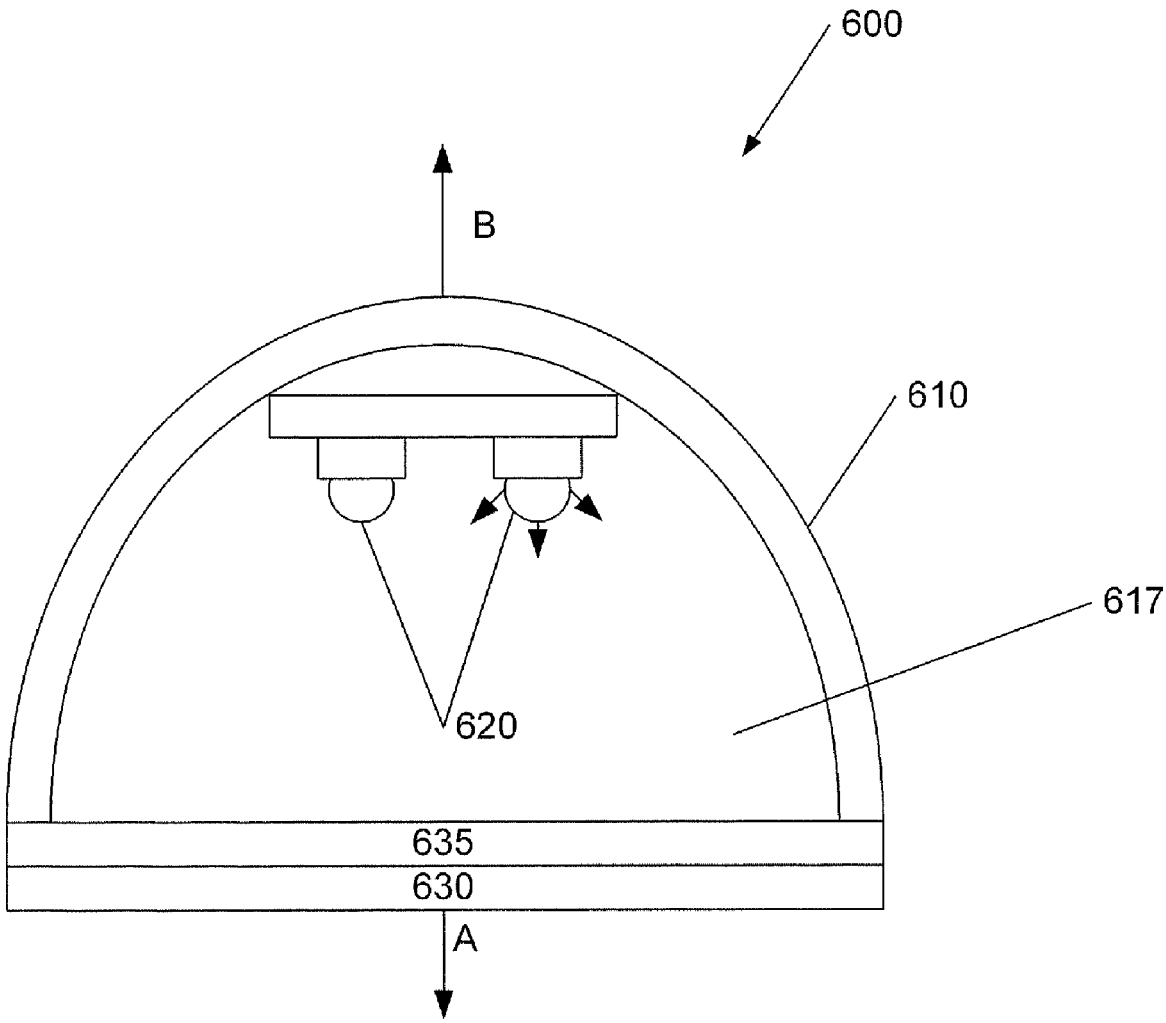
FIG. 6 is a cross section of a lighting system according to some embodiments of the present invention.

Referring now to FIG. 6, a cross section of lighting systems according to some embodiments of the present invention including a phosphor to provide white light will be discussed. As illustrated in FIG. 6, the lighting system 600 includes a housing 610 and one or more LEDs 620 inside the housing 610. As discussed above, the housing can be substantially reflective or semi-reflective without departing from the scope of the present invention. In embodiments of the present invention illustrated in FIG. 6, the one or more LEDs 620 are blue LEDs and a phosphor 635 is provided remote from the LEDs 620. As illustrated, a phosphor coating 635 is provided on the lens 630, which converts a portion of the blue light generated by the blue LEDs into a mixture of yellow and blue. The mixture of yellow and blue will be visible as white. The blue and yellow light may pass through the lens 630 in the primary direction A and/or may be reflected and pass through the housing 610 to emit light in the secondary direction B.

Phosphors and the details associated therewith are discussed in copending U.S. patent application Ser. No. 11/708,818 entitled LED LIGHTING SYSTEMS INCLUDING LUMINESCENT LAYERS ON REMOTE REFLECTORS to Nicholas W. Medendorp, Jr., filed on Feb. 21, 2007, the disclosure of which is hereby incorporated herein by reference as if set forth in its entirety.

Figure 9:
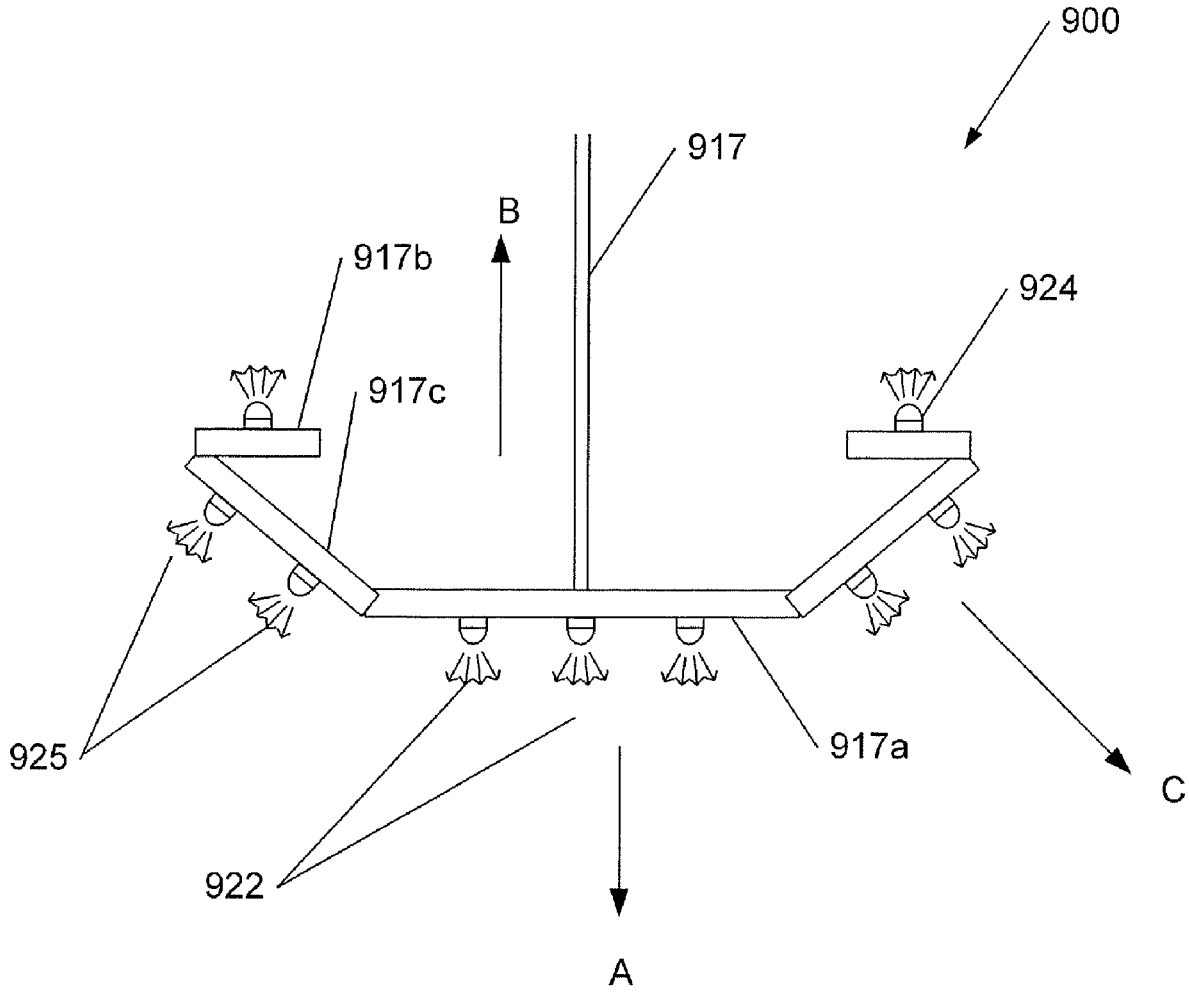
FIG. 9 is a diagram of a lighting system according to some embodiments of the present invention.

Referring now to FIG. 9, a diagram of a lighting system 900 according to some embodiments of the present invention will be discussed. As illustrated in FIG. 9, the lighting system 900 includes an LED mount 917 having three portions 917*a*, 917*b* and 917*c*, each portion 917*a*, 917*b* and 917*c* allowing the LEDs to be mounted to emit light in different directions. As illustrated, the LEDs 922 provided on a first portion of the mount 917*a* emit light in a first direction A, the LEDs 924 provided on a second portion of the mount 917*b* emit light in a second direction B and the LEDs 925 provided on a third portion of the mount 917*c* emit light in a third direction C. Positioning the LEDs 922, 924 and 925 on a mount 917 so that they emit light in multiple directions may reduce the occurrence of dark spots in the first, second and third directions A, B and/or C. Although the LED system 900 of FIG. 9 does not include a housing, lens, phosphor and the like, it will be understood that any of these items may be present without departing from the scope of the present invention. For example, the LED system 900 may be provided in a lens housing to protect the LEDs 922, 924 and 925.

It will be further understood that the mount 917 may be modified to further regulate the desired output of the lighting system 900 without departing from the scope of the present invention. Furthermore, the location of the LEDs 922, 924 and 925 may be adjusted or angled to adjust the light output by the lighting system 900.

In some embodiments of the present invention, one or more of the LEDs 922, 924 and 925 may be replaced with color LEDs to change the appearance of the light emitted from the lighting system 900. For example, the LEDs 924 may be blue LEDs and may emit blue light onto a surface in the second direction B. Thus, different surfaces may be illuminated with different color light. Providing the LEDs 925 at an angle may allow more differentiation in the light emitted from the lighting system 900 in accordance with some embodiments of the present invention.

Figure 7:
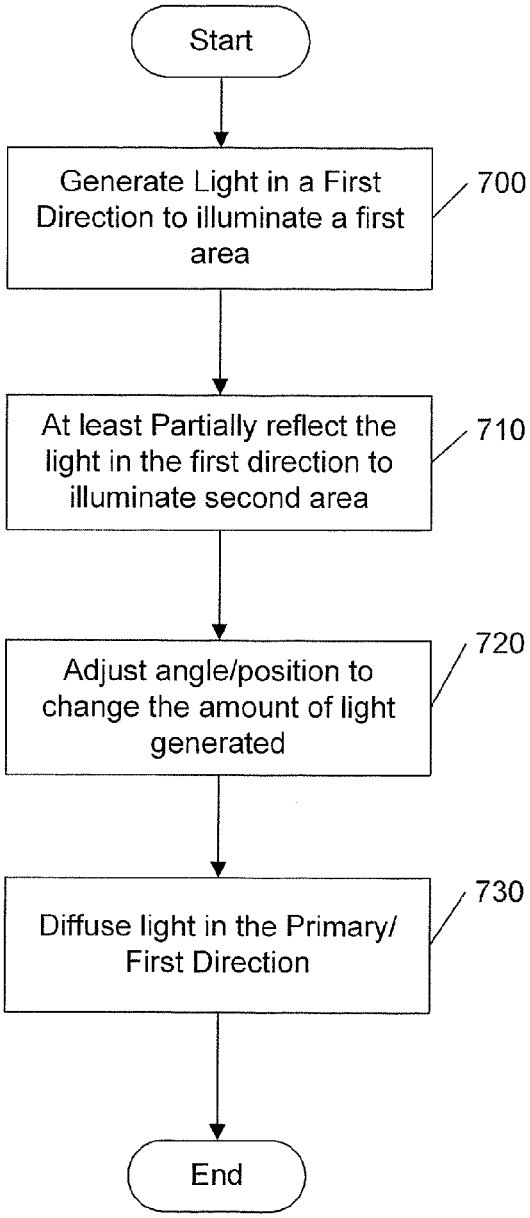
FIGS. 7 and 8 are flowcharts illustrating steps for emission of light in multiple directions using lighting systems including LEDs according to various embodiments of the present invention.
Figure 8:
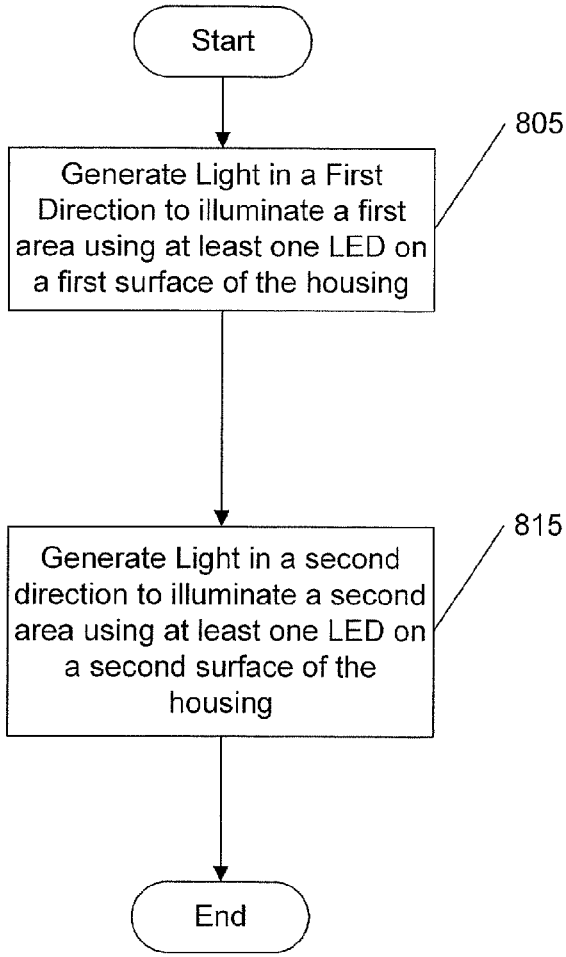

Operations for providing emission of light in multiple directions using lighting systems including LEDs will now be discussed with respect to the flowcharts of FIGS. 7 and 8. Referring first to FIG. 7, operations begin at block 700 by generating light in a first direction to illuminate a first area proximate to a lighting system using at least one LED. As discussed above, lighting systems according to some embodiments of the present invention may be used to illuminate rooms having high ceilings. Most of the light generated by the lighting systems may be directed in a primary direction, for example, towards the floor. A portion of the generated light in the first direction is reflected by a semi-reflective housing so as to allow a remaining portion of the generated light to pass through the housing in a second direction, different from the first direction, and illuminate a second area proximate to the lighting system (block 710). Thus, according to some embodiments of the present invention, some of the light generated may pass through the housing and provide backlighting and may illuminate, for example, the ceiling. Thus, the room may appear less cave-like according to some embodiments of the present invention. The angle and/or position may of the LEDs, housing, mount or the like may be adjusted to change or customize the amount of light generated by the lighting system.

As discussed above, the majority of the light may be provided in the first/primary direction, for example, from about 75 to about 90 percent of a total amount of light generated by the one or more LEDs may be provided in the first direction. Thus, only about 10 to about 25 percent of the total amount of light generated by the one or more LEDs may be provided in the second direction.

Optionally, in some embodiments of the present invention, the light generated in the first direction may be diffused using a lens between the at least one LED and the first area proximate to the lighting system.

Methods for emitting light in multiple directions using lighting systems including LEDs according to further embodiments of the present invention will now be discussed with respect to the flowchart of FIG. 8. Operations begin at block 805 by generating light in a first direction to illuminate a first area proximate to the lighting system using a first of at least two LEDs positioned on a first surface of the housing. Light is in a second direction, different from the first direction, to illuminate a second area proximate to the lighting system using a second of the at least two LEDs positioned on a second surface of the housing (block 815). Thus, according to some embodiments of the present invention, the housing may be substantially reflective and LEDs may be provided on multiple surfaces so as to allow multiple areas around the lighting system to be illuminated, for example, the floor and the ceiling.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A lighting system for emitting light in multiple directions comprising:

at least one light emitting device (LED) configured to generate light in a first direction to illuminate a first area proximate to the lighting system; and a housing configured to receive the at least one LED, the housing being configured to reflect a portion of the generated light so as to allow a remaining portion of the generated light to pass through the housing in a second direction, different from the first direction, and illuminate a second area proximate to the lighting system, wherein the first and second areas proximate to the lighting system are outside the housing, wherein the first direction is below the housing and the second direction is above the housing.

2. The lighting system of claim 1, further comprising a lens between the at least one LED and the first area proximate to the lighting system, the lens being configured to diffuse the light generated to illuminate the first area.

3. The lighting system of claim 1, wherein the at least one LED comprises at least two LEDs, a first of the at least two LEDs positioned to emit light in the first direction and a second of the at least two LEDs being positioned to emit light in the second direction.

4. The lighting system of claim 3, further comprising a third LED being positioned to emit light in a third direction, different from the first and second directions.

5. The lighting system of claim 1, wherein the at least one LED comprises at least one blue LED and wherein the system further comprises:

a transparent lens between the at least one blue LED and the first area proximate the lighting system; and a phosphor coating on the transparent lens between the transparent lens and the at least one blue LED, the phosphor coating being configured to allow the lighting system including the at least one blue LED to provide white light in the first direction.

6. A lighting system for emitting light in multiple directions comprising:

at least one light emitting device (LED) configured to generate light in a first direction to illuminate a first area proximate to the lighting system; and a housing configured to receive the least one LED, the housing being configured to reflect a portion of the generated light so as to allow a remaining portion of the generated light to pass through the housing in a second direction, different from the first direction, and illuminate a second area proximate to the lighting system wherein the first and second areas proximate to the lighting system are outside the housing, wherein from about 75 to about 90 percent of a total amount of light generated by the at least one LED illuminates the first area and wherein from about 10 to about 25 percent of the total amount of light generated by the at least one LED illuminates the second area.

7. The lighting system of claim 6, wherein a viewing angle of the at least one LED is from about 100 to about 120 degrees.

8. A lighting system for emitting light in multiple directions comprising:

at least one light emitting device (LED) configured to generate light in a first direction to illuminate a first area proximate to the lighting system; and a housing configured to receive the at least one LED, the housing being configured to reflect a portion of the generated light so as to allow a remaining portion of the generated light to pass through the housing in a second direction, different from the first direction, and illuminate a second area proximate to the lighting system, wherein the first and second areas proximate to the lighting system are outside the housing, wherein the housing defines a cavity, wherein the at least one LED is positioned to emit light into the cavity towards the housing, wherein the housing is configured to reflect at least a portion of the light emitted into the cavity to illuminate the first area proximate to the lighting system and wherein the housing comprises a semi-reflective housing including silver, chrome, metal alloys and/or any semi-reflective material.

9. A method of emitting light in multiple directions in lighting systems including light emitting devices (LEDs) comprising:

generating light in a first direction to illuminate a first area proximate to the lighting system using at least one LED; and reflecting a portion of the generated light in the first direction using a semi-reflective housing so as to allow a remaining portion of the generated light to pass through the housing in a second direction, different from the first direction, and illuminate a second area proximate to the lighting system, wherein the first and second areas proximate to the lighting system are outside the semi-reflective housing.

10. The method of claim 9, further comprising adjusting an angle and/or position of the at least one LED to change an amount of light output by the lighting system.

11. The method of claim 10, wherein the light in the first direction comprises about 75 to about 90 percent of a total amount of light generated by the at least one LED and the light generated in the second direction is from about 10 to about 25 percent of the total amount of light generated by the at least one LED.

12. The method of claim 9, further comprising diffusing the light generated in the first direction using a lens between the at least one LED and the first area proximate to the lighting system.

13. The method of claim 9, wherein the first direction is below the housing and the second direction is above the housing.

* * * * *